US006604693B2

(12) United States Patent
Santagiuliana

(10) Patent No.: US 6,604,693 B2
(45) Date of Patent: Aug. 12, 2003

(54) METHOD OF SPRAYING LIQUIDS UNDER THE FORM OF FOAM BY MEANS OF DEFORMABLE CONTAINERS AND DEVICE USING THIS METHOD

(75) Inventor: Stefano Santagiuliana, Caldogno (IT)

(73) Assignee: Taplast SpA, Dueville (IT)

( * ) Notice: Subject to any disclaimer, the term of this patent is extended or adjusted under 35 U.S.C. 154(b) by 0 days.

(21) Appl. No.: 10/130,707

(22) PCT Filed: Dec. 1, 2000

(86) PCT No.: PCT/EP00/12090

§ 371 (c)(1),
(2), (4) Date: May 22, 2002

(87) PCT Pub. No.: WO01/39894

PCT Pub. Date: Jun. 7, 2001

(65) Prior Publication Data

US 2002/0179735 A1 Dec. 5, 2002

(30) Foreign Application Priority Data

Dec. 2, 1999 (IT) ..... VI99A0245

(51) Int. Cl.[7] ..... B05B 7/30

(52) U.S. Cl. ..... 239/343; 222/190; 222/205

(58) Field of Search ..... 239/343; 222/190, 222/205

(56) References Cited

U.S. PATENT DOCUMENTS 4,274,594 A * 6/1981 Ito ..... 239/327
5,048,750 A * 9/1991 Tobler ..... 222/190
6,394,315 B1 * 5/2002 Banks ..... 222/190

FOREIGN PATENT DOCUMENTS

DE 91 10 905 1/1993

* cited by examiner

*Primary Examiner*—Michael J. Hayes
*Assistant Examiner*—Lina R Kontos
(74) *Attorney, Agent, or Firm*—Dykema Gossett PLLC

(57) ABSTRACT

A spraying device for dispensing liquids which foam by deformation of a container. A first body is coupled is the neck of a container. The body forms a chamber where an air liquid mixture is produced. A filter is located over a spraying duct for producing foam as the liquid passes therethrough. A second body surrounds the first body and contains a measured volume of liquid which enters the chamber from the suction tube when the container is inverted.

8 Claims, 8 Drawing Sheets

METHOD OF SPRAYING LIQUIDS UNDER THE FORM OF FOAM BY MEANS OF DEFORMABLE CONTAINERS AND DEVICE USING THIS METHOD

This invention concerns a method of spraying liquids under the form of foam produced by means of containers deformed by being manually squeezed and also the device that uses this method.

It is common knowledge that the market is seeing an increasing diffusion of deformable containers made of plastic that by the pressure of a hand and by means of suitable devices, spray a mixture of liquid and air under the form of a foam.

These containers are gaining more and more significant market segments because they are versatile and overcome several environmental problems. In effect, these containers can spray foams without resorting to special, pressurized gases. What's more both the containers, and the devices that dispense these mixtures, are preferably made entirely of plastic and therefore have a minimal environmental impact since the plastic can be recycled and they do not have other materials such as for example metal or likewise any incompatible materials with the actual plastic. Moreover, these containers can be refilled after their first use and therefore be used for several recharges. These kinds of foam forming devices have the most diverse fields of use. In the cleaning sector foams are produced for cleaning bathrooms, windows, for cleaning for instance kitchen ovens, for cleaning furniture or for dispensing soap, shampoo, or facial care products. With regards to personal health and hygiene, foam-based products are found for instance in hand, hair and skin care products, for creating shaving foam, or furthermore for cleaning products for pets such as dogs and cats. There are also applications in specific medical sectors such as for example foams for protective sun lotions to be applied to the skin, and many more.

There are essentially two devices on the market capable of spraying foams without pressurized gas: one type prescribes the use of a hand operated pump and mixes air and liquid in a mixing chamber to then form the foam. De-U-91 10 905 discloses a container with a manual spraying device having a first body coupled with the container and having a second body in which it arrives the liquid of the container to be mixed in a mix chamber with the air. Other devices can be found on the market that operate by squeezing the container by means of hand pressure, these consist of a cap applied to the neck of the bottle, which encloses a chamber that, when the container is squeezed by hand, receives the liquid sucked up by a suction tube in the container and the air contained in the container itself. The mixture of liquid and air collected in this chamber is discharged from the chamber by the introduction of additional liquid and an additional input of air and is transformed into foam since the outlet duct for this mixture has a filter element provided with suitable pinholes that allow, also as a function of the liquid's viscosity characteristics and the quantity of air mixed with said liquid, to produce a discharge of the mixture under foam form. These types of containers can be used both upright and overturned. It has been noted that when the container operates overturned, for instance to dispense the foam on sanitary units or oven hobs or on anything else, the first spray that comes from the container is made under liquid form and not foam. All this is because the liquid contained in the suction tube inside the container is discharged by gravity at such a speed that it does not permit the correct mixture between liquid and air.

The main scope of this invention is to produce a method of spraying liquid contained in a deformable container under the form of foam and a device that performs this method, in such a way that, right from the first spray, it however and always ensures that the product discharged from the container is dispensed under foam form and not in liquid form. A particular intention is to ensure that the first spray is under foam form regardless of whether the container is squeezed in an upright or overturned position.

Another scope is to ensure a constant quality during each spray and regardless of the liquid that is dispensed.

Last but not least, a scope of this invention is to produce a device that is inexpensive, easy to construct and also easy to assemble, even with automated type equipment.

The invention's scopes are achieved by a spraying device for liquids to dispense under foam form by manually squeezing and deforming a container the main features of said spraying device being according to claim 1.

The invention also produces a method of spraying an air-liquid mixture under foam form from the spraying device of the type described above, where said method comprises:

- at least one first liquid expelling stage from the suction tube by hand squeezing and deforming the container;
- a second introduction stage of air into the container;
- a third further squeezing stage of the container with spraying of the mixture under foam form, said method being characterized in that during said first expelling stage said liquid is collected and held inside said second chamber belonging to said device.

One advantage according to the invention is that, by creating a second chamber in the device, to contain the liquid sucked up from the suction tube, this prevents the first spray with the container, whether it is upright or overturned, from creating a condition where the product is sprayed in liquid form and not under the form of foam.

The advantages for the consumer are quite clear and apparent, since he/she can always have a constant standard spray of product thereby avoiding for example product concentrations that could be damaging to their applications. Additional characteristics and details of the invention related to the device and the proposed method shall be explained below in the description of a preferred form of execution of the device given as a guideline but not a limitation and illustrated in the attached diagrams, where:

Figure 6:
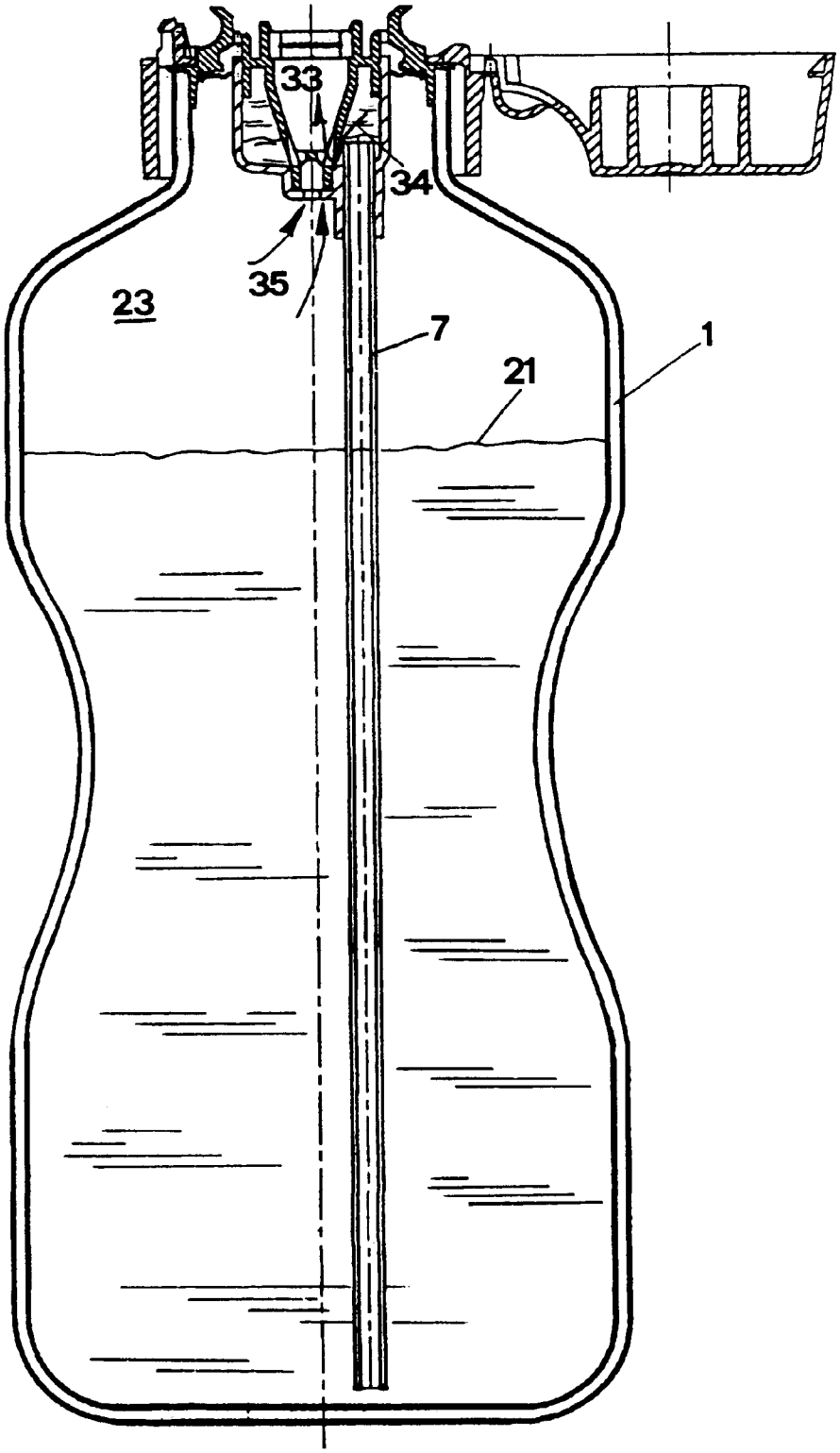
Figure 7:
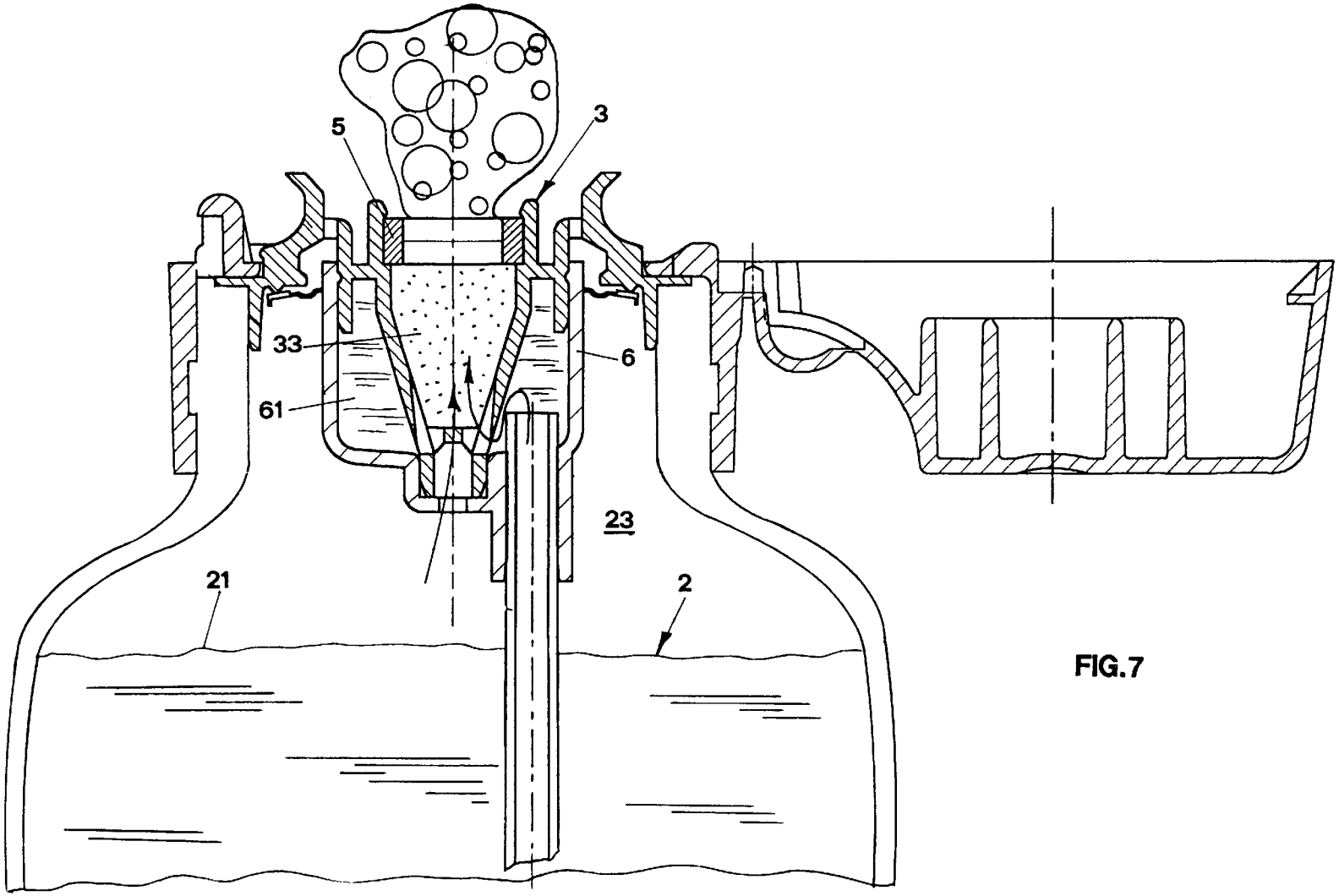

FIGS. 6 and 7 respectively show the sequence of the stages of transferring liquid from the suction tube to the second chamber of the device with an upright container, and of spraying of foam from a container.

First of all a operating description of the spraying invention device is given with the container overturned and then the operation of the invention device with an upright container will be described.

Operation with the Container Overturned

Figure 1:
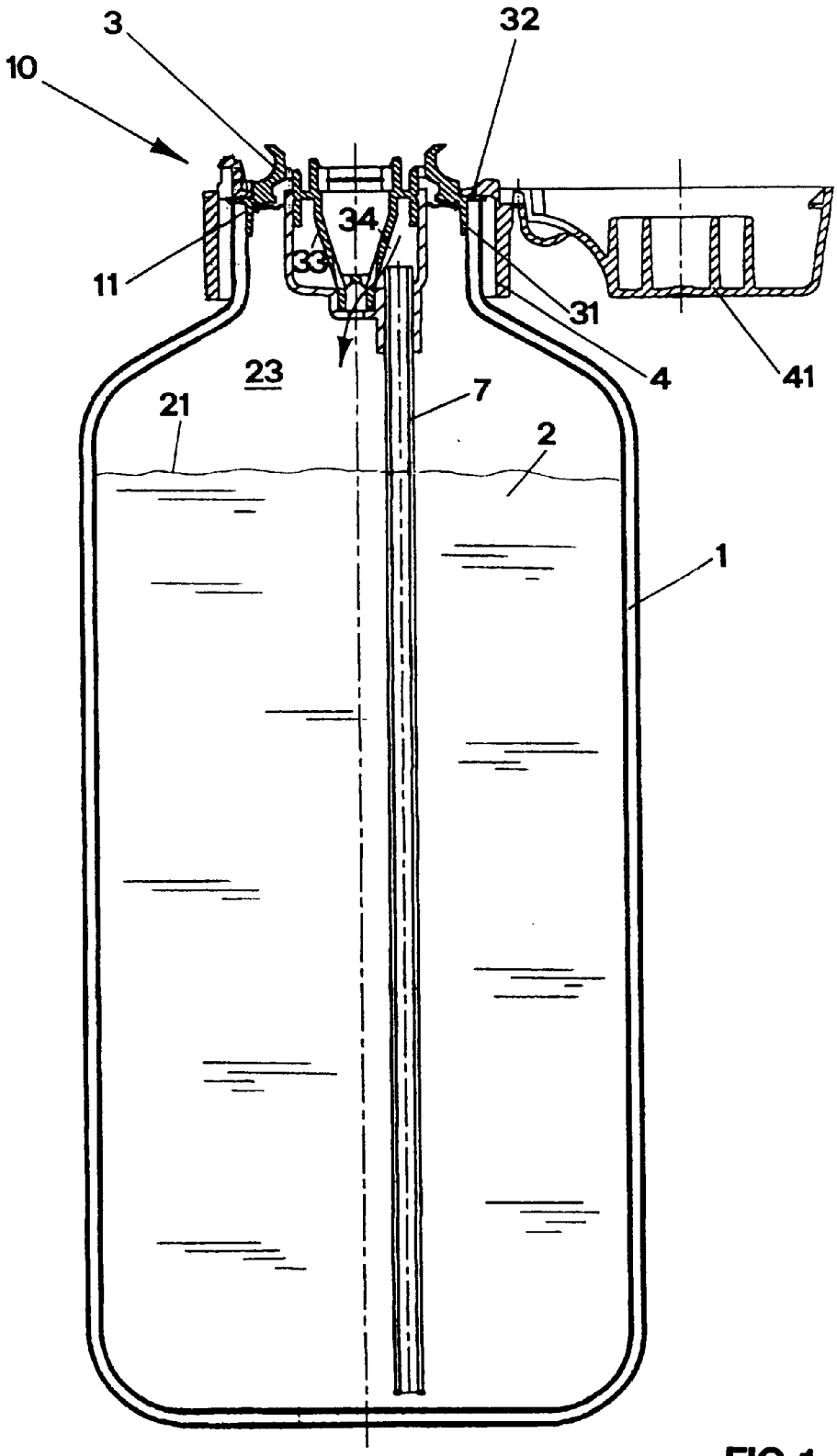
FIG. 1 shows the invention device with the container standing idle.

With reference to the aforesaid figures it can be seen in FIG. 1 that the container invention, generally indicated by 1, is a bottle made of plastic, easily squeezed by the hand that is holding it. Said container is filled with liquid 2 up to the level shown in FIG. 1 and the invention device, generally indicated by 10, is applied to the neck of said container 1, the device comprising a first body 3 that is fitted watertight onto the neck 11 of the container 1, being provided with a ring 31 that fits directly into the neck of the container and a flat flange 32 that rests on the outer rim of the container. The body 3 also encloses a first chamber 33 where, as will be explained below, the mixture between air and liquid is made. Said chamber 33 has several air feed ducts 34 distributed in a radial pattern and a liquid feed duct 35.

It must be noted that in the example that follows, which examines the operation of the device with an upright instead of overturned container, the ducts indicated here as the air and the liquid feeds, are determined to have their functions inverted, and in other words the air feed ducts will be the liquid feed ducts and the liquid feed duct will become the duct that feeds the air, all without changing the essence of operation of the invention device.

Figure 4:
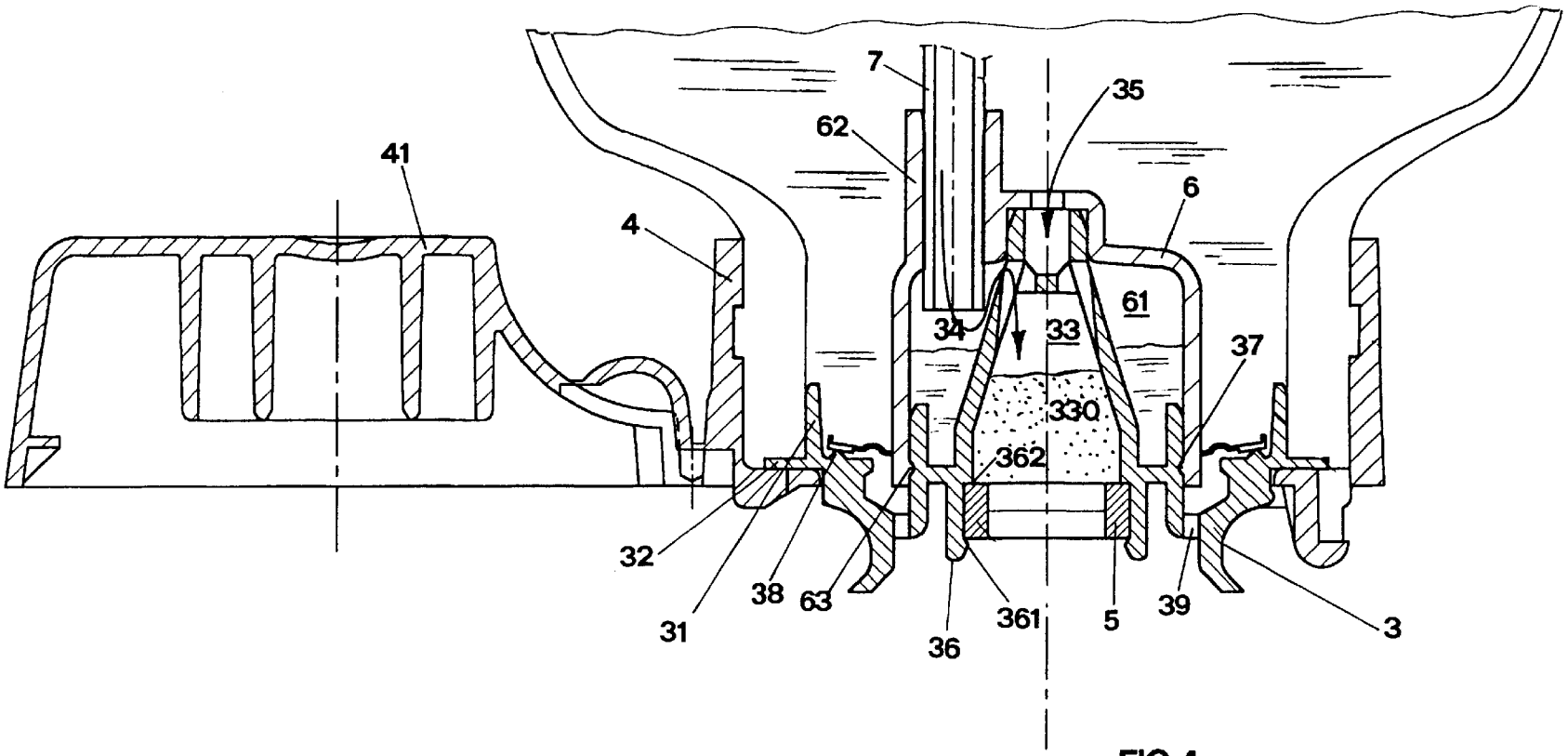
FIG. 4 shows a blown-up section of the invention device.

The case of the example shown in FIG. 1, and with more detail in FIG. 4, illustrates how said first chamber 33 has, in line with the spraying duct 36, a filter element, indicated by 5, that, as will be seen, effects the transformation of the air-liquid mixture into foam according to known technology. Said filter element 5 is held in place by a circular lip 361 that allows the filter element 5 to be clipped into position between the lip 361 and the check 362 where the first mixing chamber 33 begins.

The spraying invention device provides a second body indicated by 6 that, at least partially, encloses the first body 3 so that together they create a second chamber 61 suited to containing the volume of liquid found in the tube 7 that sucks up the liquid 2 held inside the container 1. The volume of said chamber 61 is no less that the volume found in the suction tube 7 and this is because, as will be seen below, the volume of liquid in the suction tube must be transferred into said second collection chamber. The second chamber 61 is connected to the first chamber through the aforementioned series of holes 34, and is also connected to the liquid 2 contained in the container 1 through the tube 7 that is inserted in a tubular protrusion 62, which receives tube 7. It can be seen that the holes 34 have a conical shape with their tighter end turned towards the wall belonging to the chamber 33 and opening into the second chamber 61.

According to the example of execution shown in FIG. 1 and blown-up in FIG. 4, the first body 3 of the device is connected to the second 6 by means of a snap-on coupling made by a circular rib 63 belonging to the second body 6 that is held by a circular cavity 37 belonging to said first body 3.

In a variant in execution of the invention the first body 3 and the second body 6 may also be obtained from a single piece by means of a known thermoplastic moulding process, for example by blow moulding.

The second body 6 is also fitted with valve devices that are represented by a circular appendage, indicated by 64, which is produced while moulding the body 6 and is limited in thickness so that it is elastic and flexible and thin enough to function as a genuine valve. This circular appendage 64, as can be seen in FIG. 4, rests on a circular rib 38 belonging to the first body 1 thereby creating a cut-off to the passage of air when the container, as will be seen, is squeezed to spray the foam. When, on the other hand, the container has to recover the air that has been expelled through the discharge of the foam produced, this air enters through the holes 39 made in the body 1 and the depression that is created inside the container lifts the circular appendage 64 and allows the passage of air.

A description will now be given of the operation of the spraying device when the container is in an overturned position.

Figure 2:
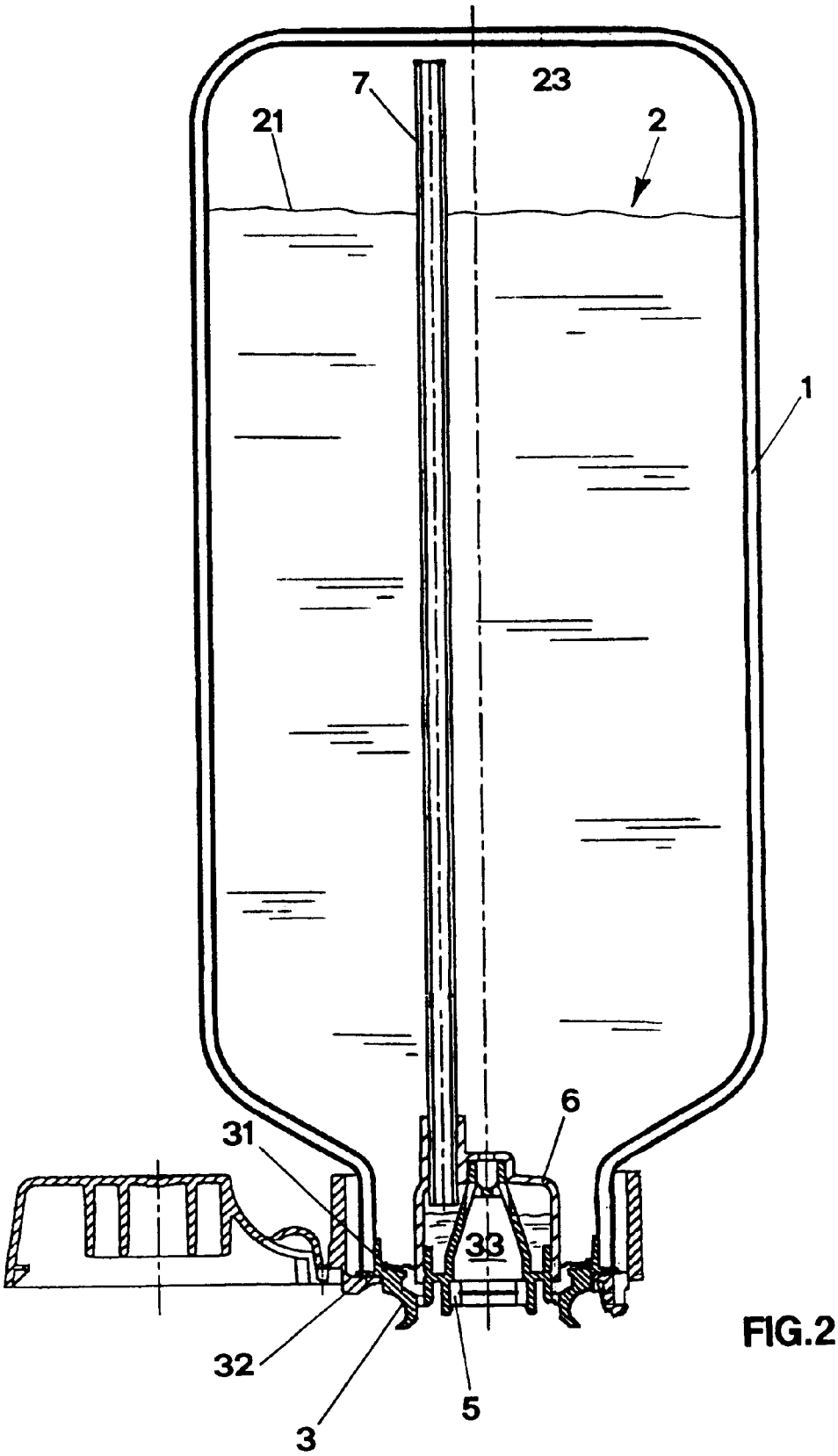
FIG. 2 shows the invention device with the container overturned during the liquid expelling stage from the suction tube.
Figure 3:
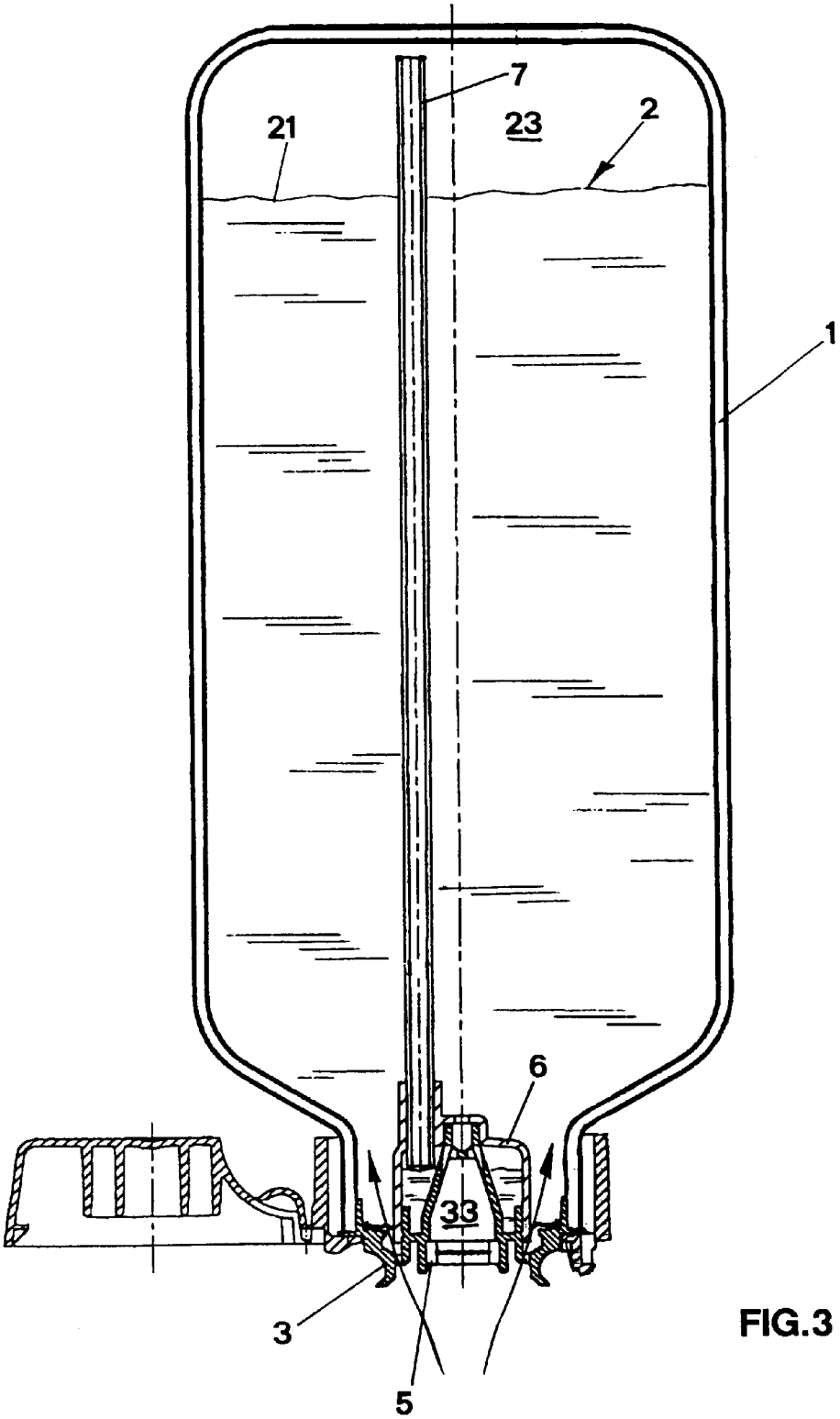
FIG. 3 shows the stage where the container is released and air returns into the actual bottle as shown in more detail in FIG. 3*a;*
Figure 3A:
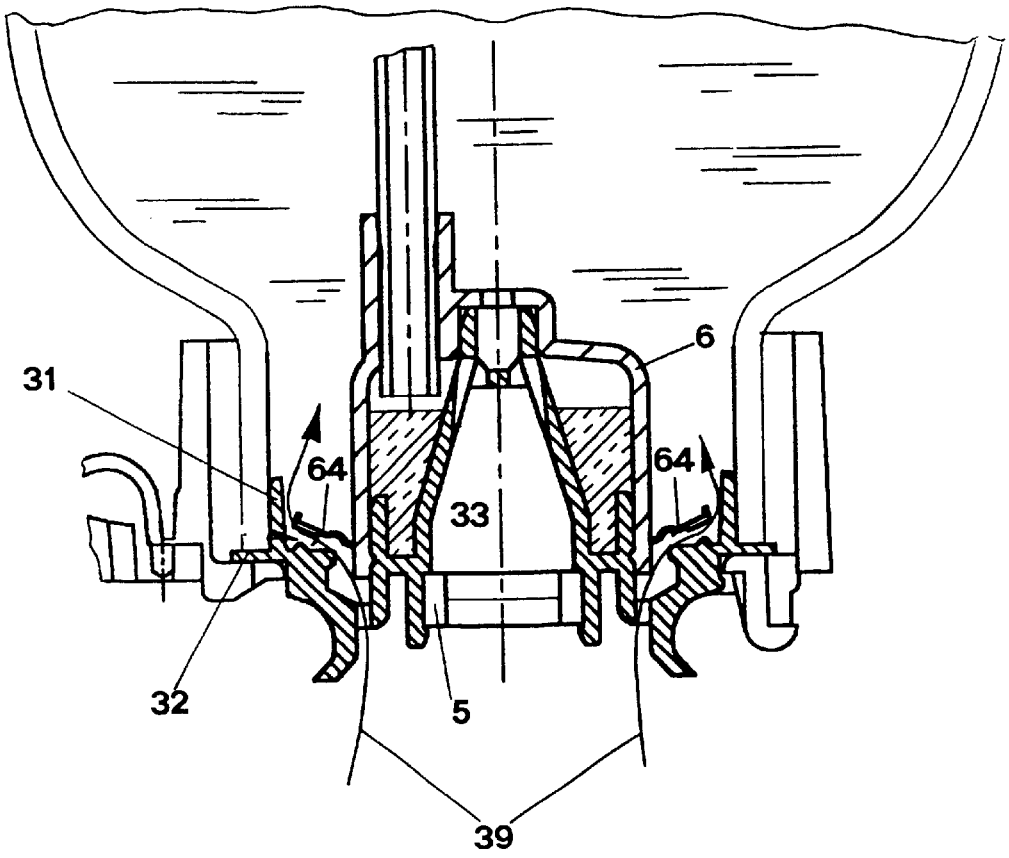

As can be seen in FIG. 1, when the container is standing idle the liquid 2 has a free surface 21 and so the liquid in the suction tube 7 is at the same level. If the container 1 is now turned over, as shown in FIG. 2, the liquid in the suction tube 7 is discharged into the second chamber 61 that, in order to receive all the liquid that is discharged, has a greater volume than the volume of liquid that can be held inside the suction tube. Once the suction tube is free of liquid 2, the suction tube fills with air by the fact that there is air 23 inside container 2. After the liquid discharging stage from the suction tube 7 there is a recovery stage taking air from the outside to inside the container through the inlet holes 39 and through the raised circular appendage 64 that allows the effective passage of air, as can for that matter be seen more clearly in the blow-up in FIG. 3*a*, which shows the circular appendage 64 raised and the consequent passage left open for the air to enter in the direction indicated by the arrows. By squeezing the container another time (see FIG. 4), this forces the air held inside the container and suction tube 7 into the second chamber 61 and from here it reaches the mixing chamber 33 through the holes 34. All this occurs together with the entry of liquid 2 in the mixing chamber 33 through hole 35, and it enters at basically the same time as the air enters so that the liquid and air create an initial, adequately uniform mixture.

Figure 5:
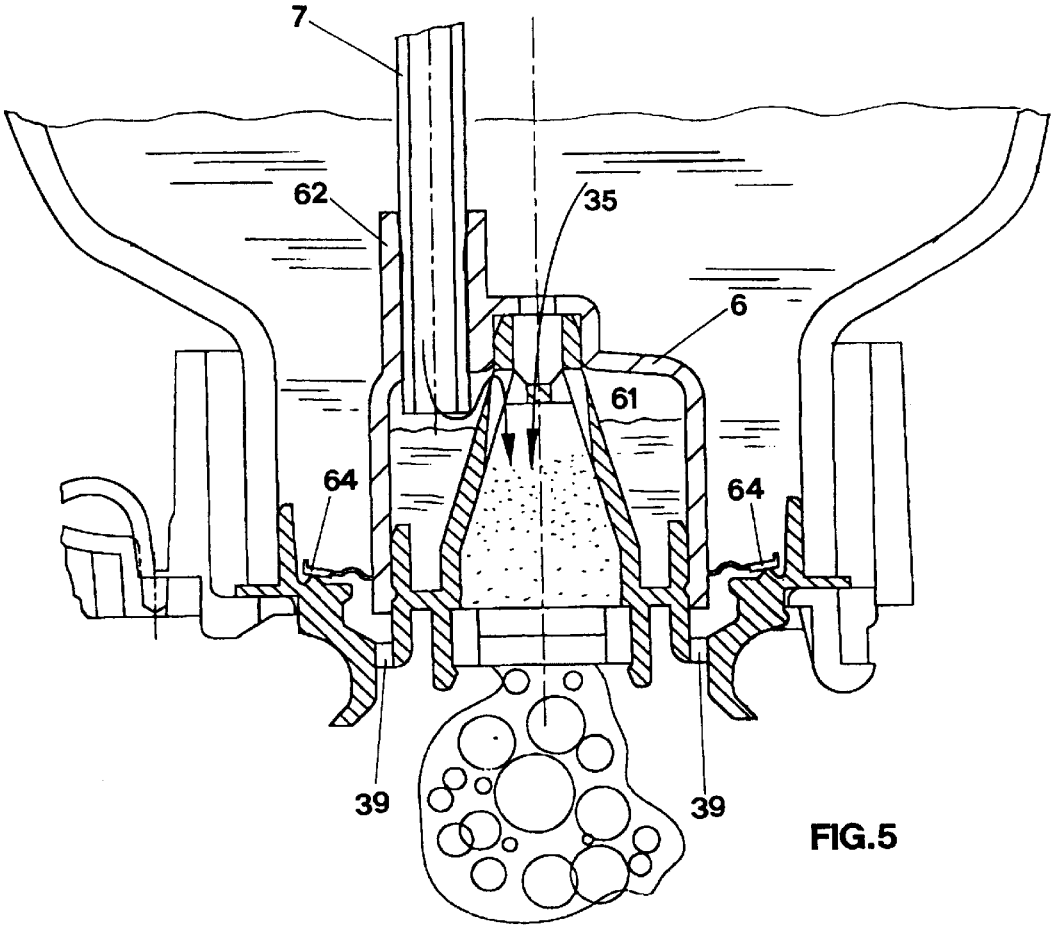
FIG. 5 shows the subsequent stage of squeezing the bottle when the mixture between air and liquid is achieved to produce foam.

By continuing to squeeze the container 2, the air-liquid mixture 330 is made to pass through the filter element 5 and in this way the desired foam is created, as shown in the blow-up in FIG. 5.

Naturally, if repeated sprays of foam are made, cycles are alternated between recovery of air by releasing the container and new foam formation by squeezing the container with a hand. When the container is no longer being used, the container returns to its initial position in FIG. 1 and all the liquid contained in the second chamber 61 is drained through the holes 34 that connect with the chamber 33 and therefore also with hole 35 that discharges the excess liquid into the container 1.

Operation with an Upright Container.

FIGS. 6 and 7 show the sequence of operations of the invention device with the container upright. During the stage illustrated in FIG. 6 and in other words squeezing the container 1 for the first time, this makes the liquid held in the suction tube 7 be first transferred into chamber 61 and then, by continuing to squeeze the container 1, this liquid passes through the holes 34 into the mixing chamber 33 through the holes 34. Equally the air 23 found between the free surface 21 of the liquid and the invention device, is discharged from hole 35 and encounters the liquid, mixing them together in the chamber 33. When the chamber 33 is full, by continuing further squeezing actions, the foam will be sprayed.

FIG. 7 shows in particular detail the route the liquid 2 and the air 23 follow through the aforesaid holes and then into the chamber 33.

The subsequent stage of recovering air through the holes 39 and the diaphragm 64 is the same as when the container is overturned.

It should be noted that, as in the previous description, the invention device ensures that the first spray, as with the others that follow, is always spraying foam and not liquid both in the case where the container is overturned and when the container is upright and this is because of the existence of the second chamber 61 that, in the case of an overturned container, acts as container for the liquid held in the suction tube 7.

What is claimed is:

1. A spraying device for dispensing liquids in the form of foam by manual pressure on a container having an open end for receiving air and liquid therein, comprising:

a first body having a neck with a watertight coupling, and at least one filter element secured in the opening in the first body, defining a first chamber for mixing the air and the liquid, said first chamber having at least one hole for admitting the air and at least one hole for admitting the liquid;

a second body surrounding a portion of said first body and defining together with said first body a second chamber having a suction tube opening and a suction tube secured therein communicating with said first chamber therethrough, for taking up a volume of liquid when the container is manually pressurized, said second chamber communicating with the container through said at least one hole for liquid and said at least one hole for air, said second chamber having a volume greater than the volume of the liquid taken up by said suction tube; and valve means formed in the first body having an outer opening for admitting air into the container to restore air inside said container after foaming.

2. The device according to claim 1, wherein said first body and said second body are connected together by a snap-on coupling comprising a rib and a corresponding mating recess formed on partly on the first body and partly on the second body.

3. The device according to claim 1, wherein said first body and said second body are produced in a single piece by a thermoplastic moulding process.

4. The device according to claim 1, wherein the first body has a circular rib extending around and being spaced away from a portion thereof surrounding the second body, and the valve means comprises a circular appendage protruding from the second body within the container and resting on the circular rib for closing the outer opening.

5. The device according to claim 1, wherein said first chamber connects with said second chamber through a series of holes made in the surface of said first chamber.

6. The device according to claim 5, wherein the at least one hole for admitting air comprises a conical opening in the first chamber having a narrow end proximate the second chamber.

7. The device according to claim 1, wherein said second body has a tubular protrusion which holds a suction tube in communication with the suction opening.

8. A method of spraying a foaming mixture of air and liquid from the container according to claim 1, comprising the steps of:

manually squeezing the container for expelling the liquid from the container through the suction tube, introducing air into the container, mixing the air and liquid by further squeezing the container to produce the foam and to spray the foam mixture from the container, and collecting and holding the liquid in the second chamber during said squeezing step for expelling the liquid.

* * * * *